US007766437B2

(12) United States Patent
Lim et al.

(10) Patent No.: US 7,766,437 B2
(45) Date of Patent: Aug. 3, 2010

(54) REFRIGERATOR

(75) Inventors: Hyung-Keun Lim, Gyeonggi-Do (KR); Chan-Ho Chun, Seoul (KR); Youn-Seok Lee, Gyeonggi-Do (KR); Yang-Gyu Kim, Seoul (KR); Sae-Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/995,168

(22) Filed: Nov. 24, 2004

(65) Prior Publication Data

US 2005/0275326 A1 Dec. 15, 2005

(30) Foreign Application Priority Data

Jun. 14, 2004 (KR) ..... 10-2004-0043747

(51) Int. Cl.
*A47B 96/04* (2006.01)
*A47B 88/00* (2006.01)

(52) U.S. Cl. ..... 312/408; 312/330.1

(58) Field of Classification Search ..... 312/401, 312/404, 408, 330.1, 265.1–265.4; 108/147.15
See application file for complete search history.

(56) References Cited

U.S. PATENT DOCUMENTS

| | | | | | |
|---|---|---|---|---|---|
| 2,103,885 | A | * | 12/1937 | Whalen | 312/404 |
| 2,950,158 | A | | 8/1960 | Harmon | |
| 3,184,862 | A | | 5/1965 | Frank | |
| 3,212,835 | A | * | 10/1965 | Beckett et al. | 312/311 |
| 5,299,863 | A | * | 4/1994 | Albright, Jr. | 312/404 |
| 5,330,261 | A | | 7/1994 | Bennett | |
| 5,486,044 | A | * | 1/1996 | Bennett | 312/321.5 |
| 5,516,204 | A | * | 5/1996 | Calvert et al. | 312/408 |
| 5,577,823 | A | * | 11/1996 | Maglinger | 312/404 |
| 5,921,647 | A | * | 7/1999 | Schneider et al. | 312/265.3 |
| 6,076,906 | A | * | 6/2000 | Royal | 312/273 |
| 6,220,682 | B1 | * | 4/2001 | Vertullo | 312/334.28 |
| 6,253,568 | B1 | | 7/2001 | Peffley | |

FOREIGN PATENT DOCUMENTS

| | | | |
|---|---|---|---|
| DE | 12 82 035 | B | 11/1968 |
| EP | 0 605 154 | A1 | 7/1994 |
| GB | 1 040 813 | A | 9/1966 |
| JP | 53-48265 | | 4/1978 |
| JP | 59-168695 | | 11/1984 |
| JP | 06-026402 | | 2/1994 |
| JP | 6-26472 | A | 2/1994 |
| JP | 2001-147072 | | 5/2001 |
| JP | 2001-227489 | | 8/2001 |
| JP | 2002 174481 | A | 6/2002 |
| JP | 2003-139069 | | 5/2003 |
| WO | WO-03 012351 | A | 2/2003 |

* cited by examiner

*Primary Examiner*—Janet M Wilkens
*Assistant Examiner*—Timothy M Ayres
(74) *Attorney, Agent, or Firm*—Birch, Stewart, Kolasch & Birch, LLP

(57) ABSTRACT

A refrigerator including a cooling chamber in a main body, includes: a rack assembly installed inside the cooling chamber; and a rack assembly drawing unit for drawing/putting the rack assembly out of/into the cooling chamber. Accordingly, food containers put on a rack of a rack assembly can be easily and conveniently taken out or checked regardless their locations by constructing the rack assembly to be selectively drawn out of a cooling chamber. Also, by attaching a vibration preventing rubber material to an end of the rack assembly, the food container put on the rack is prevented from being dropped, and the vibration noise can be effectively prevented.

22 Claims, 8 Drawing Sheets

REFRIGERATOR

BACKGROUND OF THE INVENTION

1. Field of the Invention

The present invention relates to a refrigerator, and more particularly, to a refrigerator which includes a rack assembly selectively drawn out of a cooling chamber so that food items put on a rack of the rack assembly can be easily taken out or checked.

2. Description of the Background Art

In general, a refrigerator is divided into a freezing chamber for storing an ice container for making ice and frozen food and a cooling chamber for storing chilled food, and a refrigerating cycle for supplying cool air to the freezing chamber and the cooling chamber is provided in the refrigerator.

FIG. 1 is a perspective view showing a conventional refrigerator, and FIG. 2 is a longitudinal sectional view showing the conventional refrigerator.

As shown, the conventional refrigerator 10 includes a freezing chamber 14 formed at an upper side of a main body 12, for storing frozen food; a cooling chamber 16 formed at a lower side of the main body 12, for storing food containers 16*a* and 16*b* or chilled food; and a door 18 disposed in front of the main body 12 to be opened or closed.

A plurality of racks 20 on which the food containers 16*a*, 16*b* are put are horizontally mounted at an upper side of the cooling chamber 16, and a vegetable container 22 is installed at a lower side of the cooling chamber 16.

The rack has a quadrangular flat plate shape, and its end 20*a* is inserted in a guide groove 24 formed at a side surface of the cooling chamber 16.

In the conventional refrigerator 10 having such a structure, a plurality of food containers 16*a*, 16*b* are put on the racks 20 to be stored.

However, as for the conventional refrigerator 10, it is very difficult to draw the rack 20 on which the food containers 16*a*, 16*b* are put from the cooling chamber 16 because the end 20*a* of the rack 20 is inserted in the guide groove 24.

Accordingly, in case that many food containers 16*a* and 16*b* are stored on the rack 20 and thus the food container 16*b* put on a rear side of the rack 20 is hidden by the food container 16*a* put on a front side of the rack, it is difficult to check or take out the food container 16*b*. In order to take out or check the food container 16*b* put on the rear side of the rack 20 in the above-described state, the food container 16*a* put on the front side of the rack should be taken out first. For this reason, inconvenience is caused, and time is undesirably consumed.

In addition, because the end of the rack is directly inserted in the guide groove without any special vibration preventing member, vibration generated by a compressor or the like in operation of the refrigerator is directly transmitted to the rack, which may cause vibration noise and undesirably move food containers put on the rack to thereby drop the containers.

SUMMARY OF THE INVENTION

Therefore, an object of the present invention is to provide a refrigerator which includes a rack assembly selectively drawn out of a cooling chamber, so that food containers put on a rack of the rack assembly can be easily taken out or checked regardless of their locations.

Another object of the present invention is to provide a refrigerator capable of preventing a food container put on a rack from being dropped and effectively preventing vibration noise by attaching a vibration preventing member to an end of a rack assembly.

To achieve these and other advantages and in accordance with the purpose of the present invention, as embodied and broadly described herein, there is provided a refrigerator including a cooling chamber in a main body, comprising: a rack assembly installed inside the cooling chamber; and a rack assembly drawing unit for drawing/putting the rack assembly out of/into the cooling chamber.

The rack assembly comprises a plurality of frames vertically installed at a certain interval; side covers located at sides of the cooling chamber; a rear cover located at a rear of the cooling chamber; and at least one rack horizontally installed in a space formed by the side covers and the rear cover.

The side cover is made of a transparent material such as an acryl material.

Preferably, a plurality of support members for supporting the racks are fixedly installed at inner surfaces of the side covers and the rear cover, and the rack support member is made of a vibration preventing material.

The rack assembly drawing unit comprises: a first guide portion formed at both sides of the cooling chamber; and a second guide portion formed at the rack assembly to be coupled to the first guide portion.

To achieve these and other advantages and in accordance with the purpose of the present invention, as embodied and broadly described herein, there is provided a refrigerator comprising: a main body including a cooling chamber therein; and a rack assembly installed inside the cooling chamber to be drawn out of the main body.

The rack assembly comprises a plurality of frames vertically installed at a certain interval in a facing manner and each having guide protrusions at both sides so as to be coupled to guide portions formed at an inner side of the cooling chamber; and at least one rack horizontally installed between the frames.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
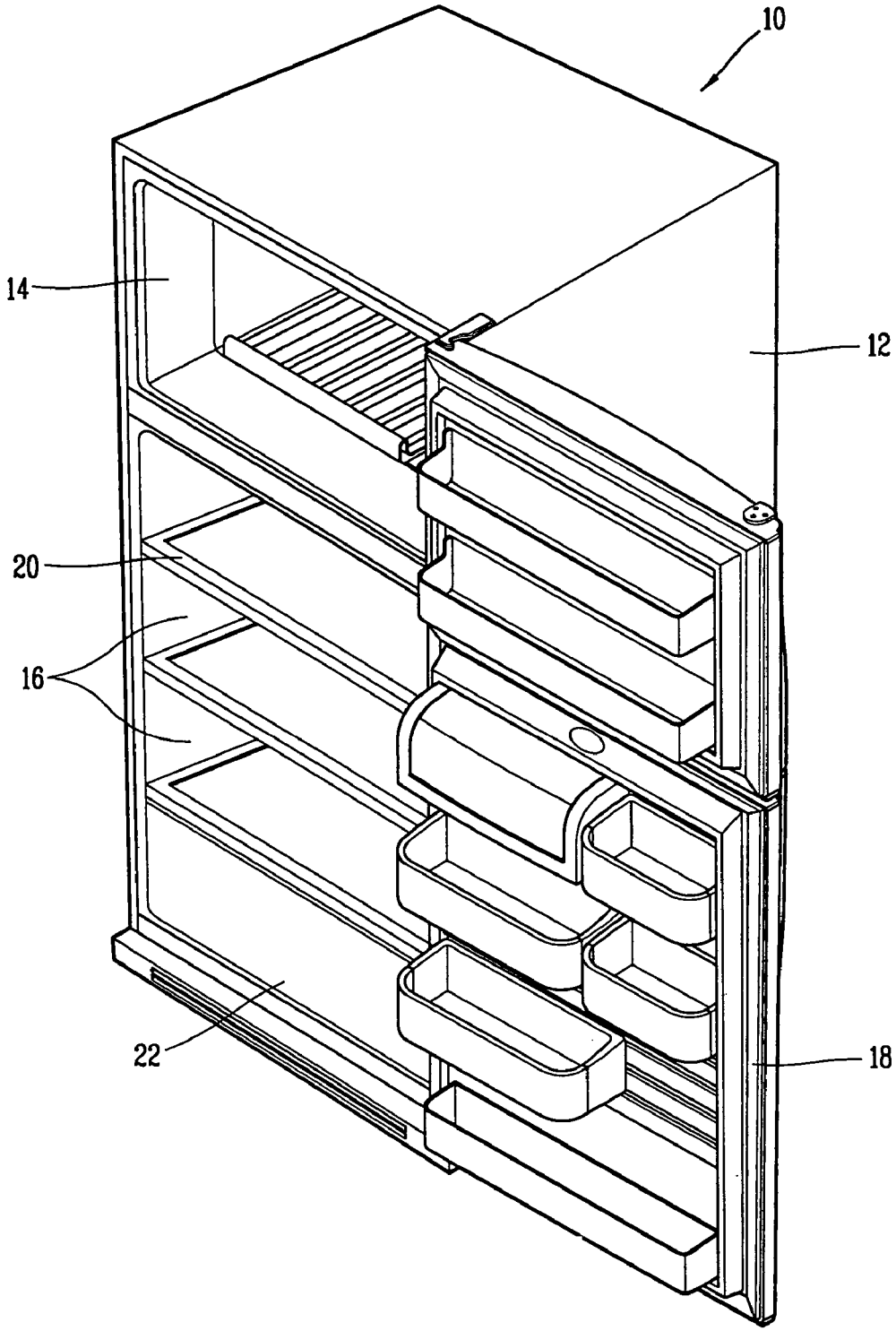
FIG. 1 CONVENTIONAL ART
FIG. 1 is a perspective view showing a conventional refrigerator.
Figure 2:
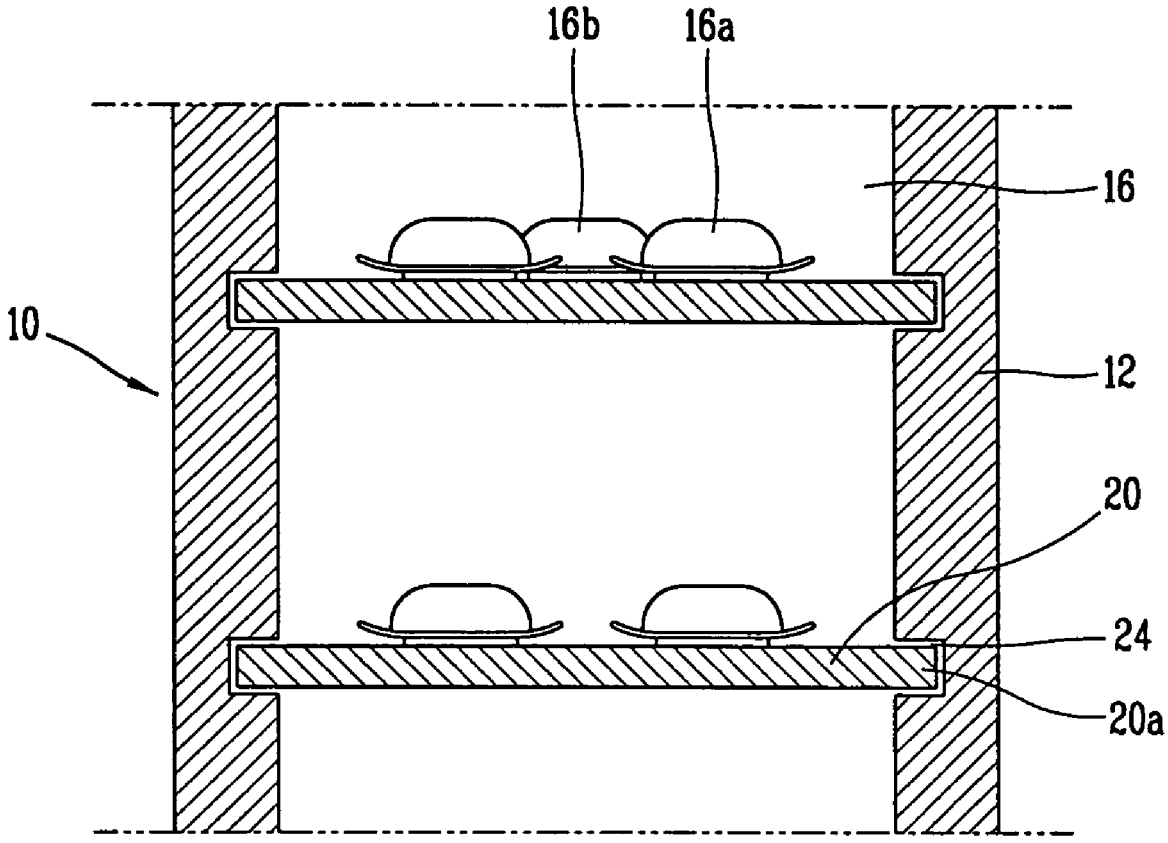
FIG. 2 CONVENTIONAL ART
FIG. 2 is a longitudinal sectional view showing the conventional refrigerator.
Figure 3:
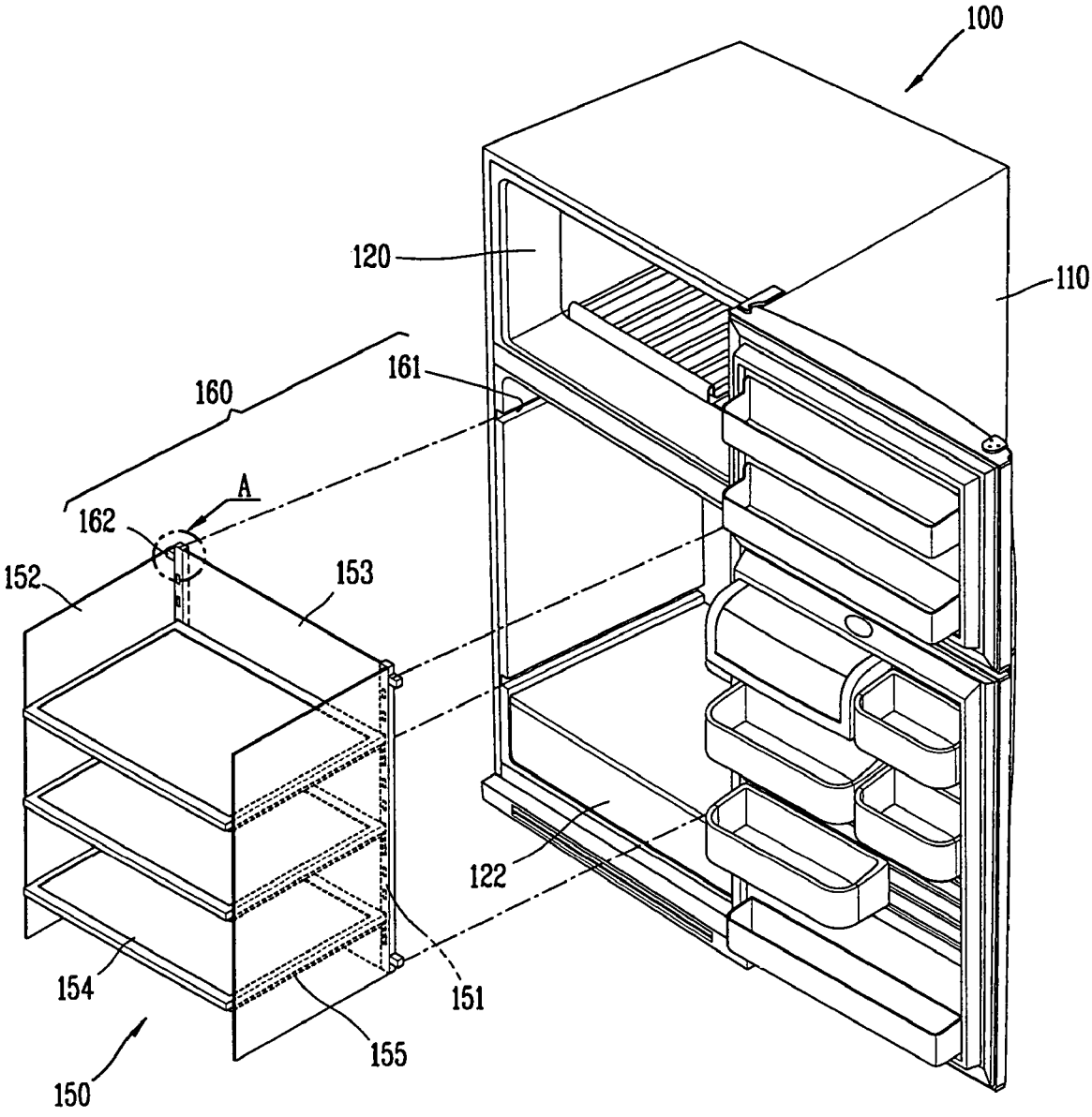
FIG. 3 is an exploded perspective view showing a refrigerator in accordance with the present invention.
Figure 4:
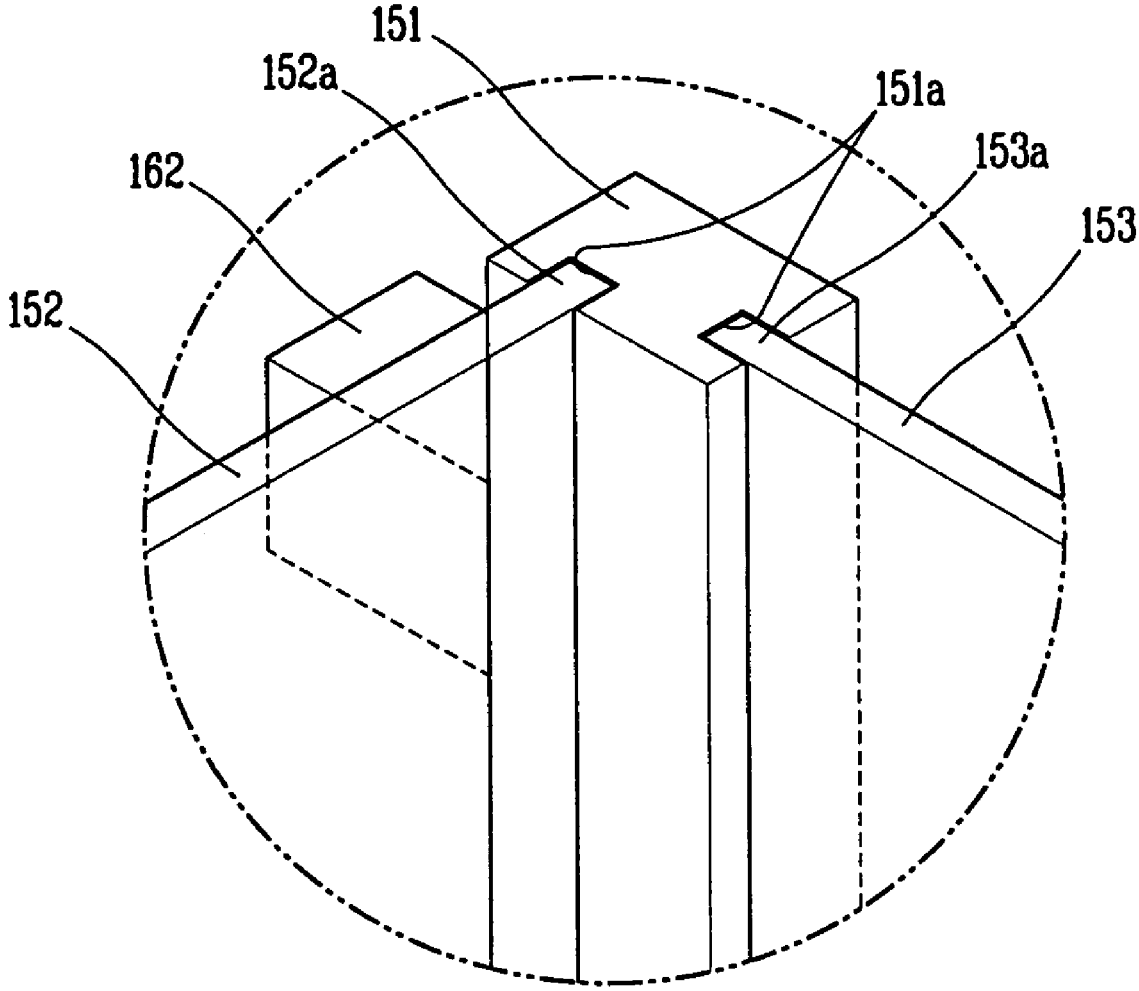
FIG. 4 is an enlarged view of part A of FIG. 3.
Figure 5:
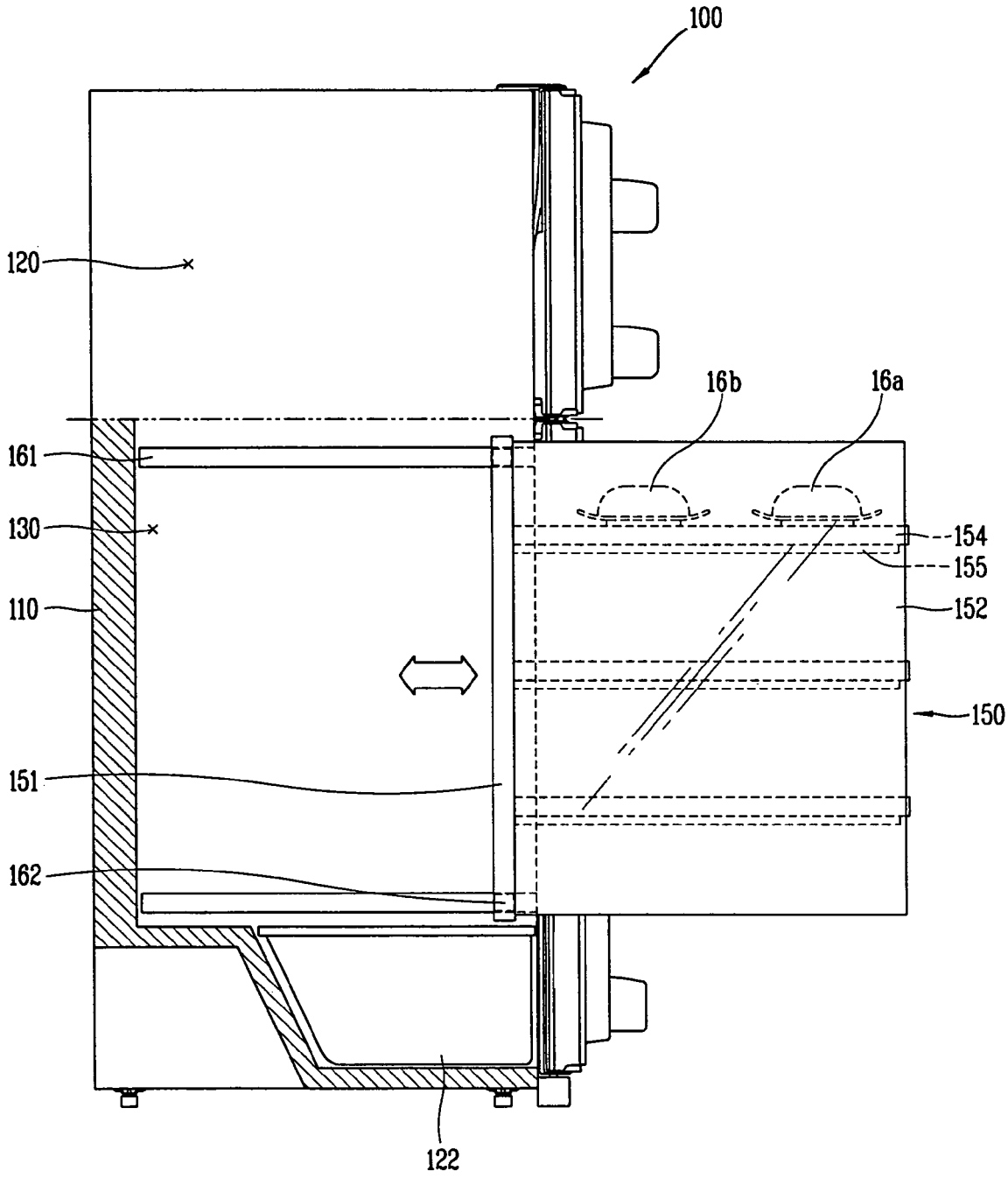
FIG. 5 is a longitudinal sectional view for explaining one example of a structure for drawing/putting a rack assembly out of/into a refrigerator in accordance with the present invention.
Figure 6:
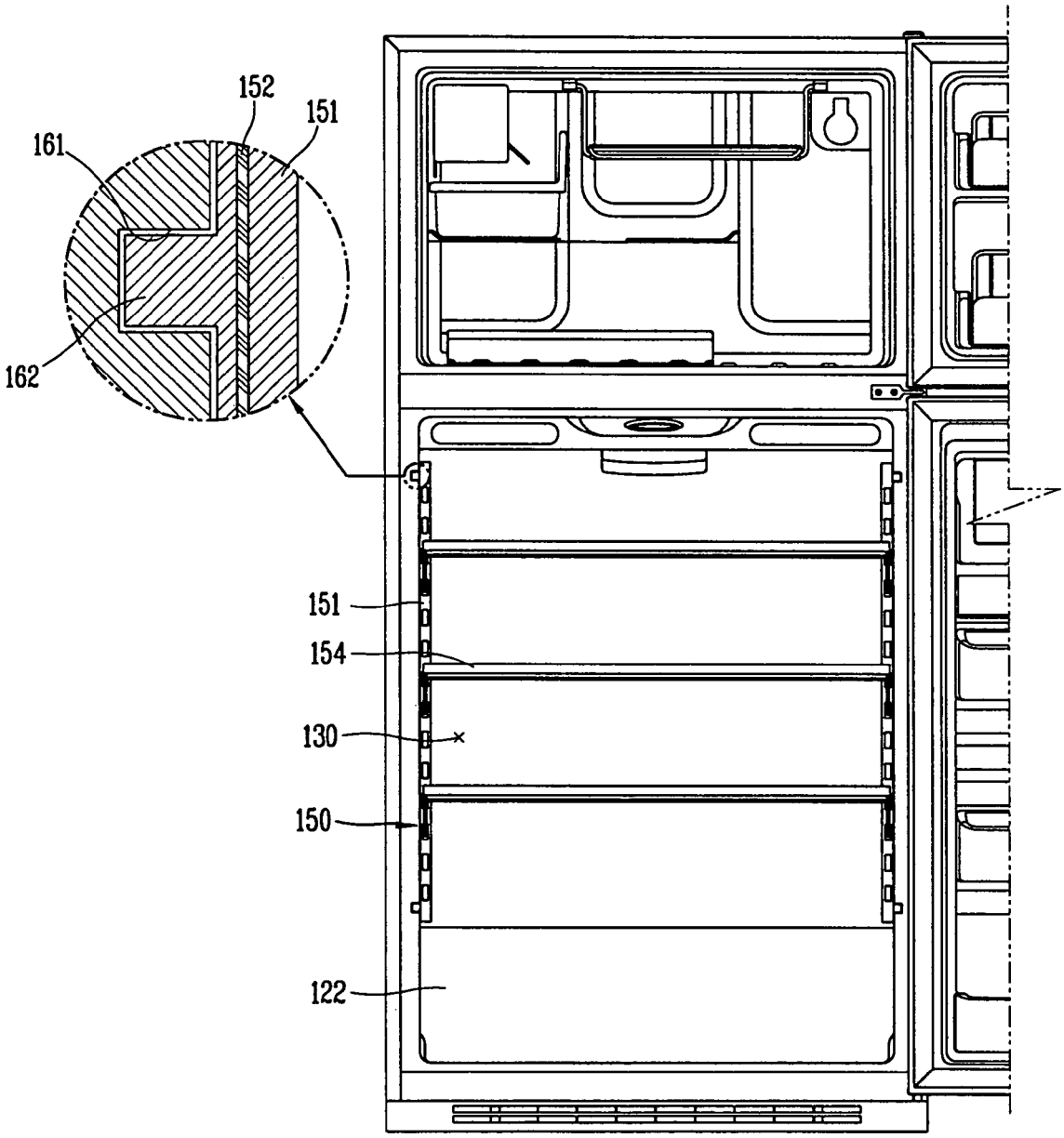
FIG. 6 is a front view showing a refrigerator in accordance with the present invention.

FIG. 3 is an exploded perspective view showing a refrigerator in accordance with the present invention, FIG. 4 is an enlarged view of part A of FIG. 3, FIG. 5 is a longitudinal sectional view for explaining a structure for drawing/putting a rack assembly out of/into a refrigerator in accordance with the present invention, and FIG. 6 is a front view showing the refrigerator in accordance with the present invention.

As shown, a refrigerator 100 in accordance with one embodiment of the present invention includes a freezing chamber 120 formed at an upper side of a main body 110, for storing frozen food; a cooling chamber 130 formed at a lower side of the main body 110, for storing food containers 16*a*, 16*b* or chilled food (not shown); a door 140 disposed in front of the main body 100 to be closed and opened; a rack assembly 150 installed inside the cooling chamber 130; and a rack assembly drawing unit 160 for allowing the rack assembly to be drawn out of the cooling chamber 130.

The rack assembly 150 is constructed such that frames 151 are vertically installed at a certain interval, side covers 152 are located in front of the frames 151, respectively, a rear cover 153 is located between the frames 151, and at least one rack 154 is horizontally installed in a space formed by the side covers 152 and the rear cover 153.

Ends 152*a* and 153*a* of the side cover 152 and the rear cover 153 are inserted in grooves 151*a* of the frame 151 to be fixed thereto, respectively. Preferably, the side cover 152 is made of a transparent material, such as an acryl material, which maintains its sufficient strength while allowing food containers put on a rack to be checked.

A rack 154 is installed inside the side cover 152 and the rear cover 153 at a certain height and is formed as a quadrangular flat plate shape.

Rack support members 155 for supporting the rack 154 are fixedly installed at an inner surface of the side cover 152 at regular intervals, and the rack support members 155 support ends of the racks, respectively.

Preferably, the rack support member 155 is made of a vibration preventing rubber material in order to prevent vibration noise.

The rack assembly drawing unit 160 includes a first guide portion 161 formed at both sides of the cooling chamber 130; and a second guide portion 162 formed at the rack assembly 150 and coupled to the first guide portions 161.

The first guide portions 161 are horizontally formed inside the main body 110, namely, at both inner side surfaces of the cooling chamber 130 as a groove structure. The second guide portions 162 are formed at sides of the frame 151 of the rack assembly 150 as a protrusion so as to be slidably coupled to the first guide portions 161.

Preferably, the second guide portion 162 is made of a vibration preventing material so that the vibration noise is not directly transmitted to the rack 154.

Figure 7:
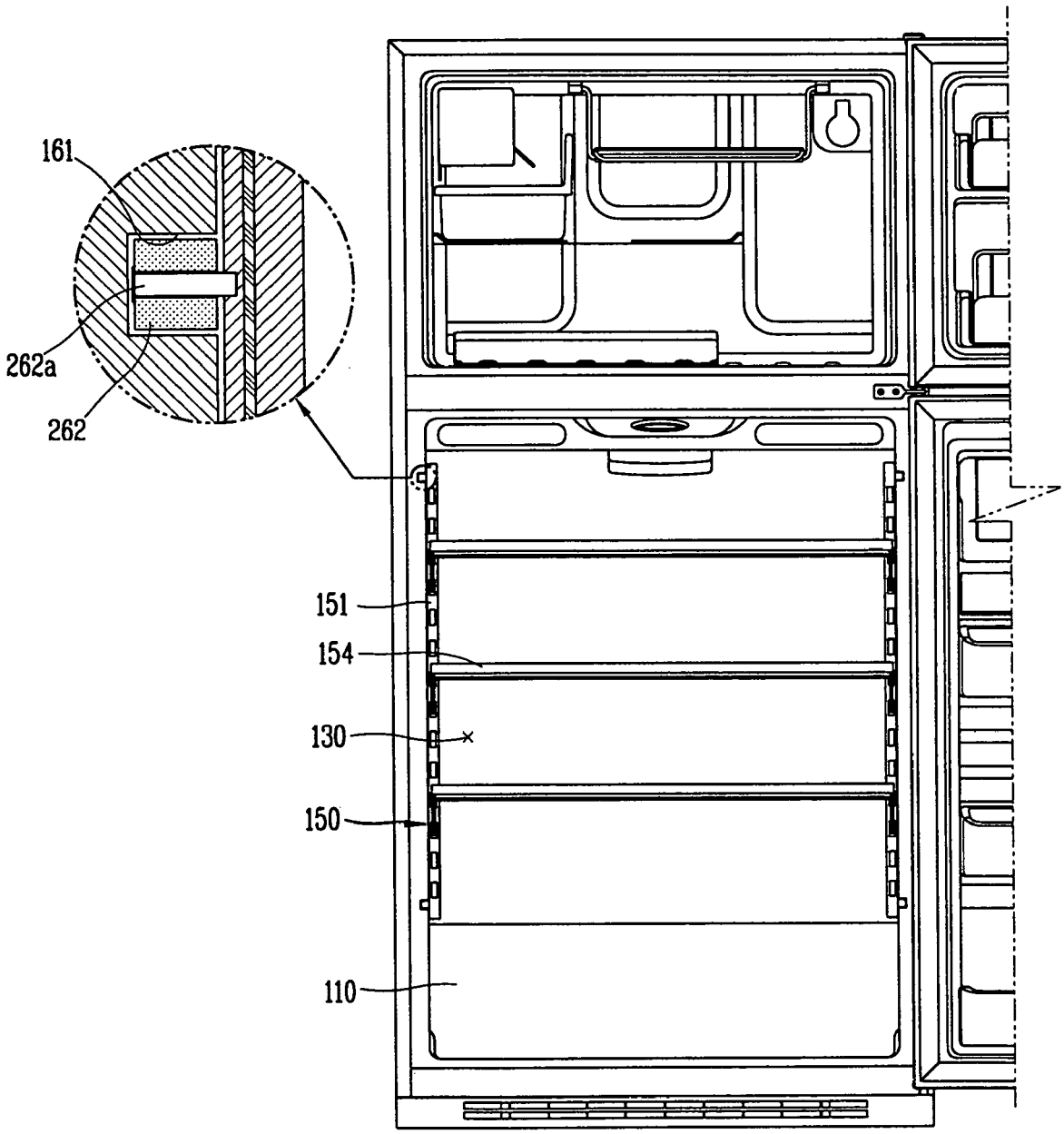
FIG. 7 is a front view showing another example of a structure for drawing/putting a rack assembly out of/into a refrigerator in accordance with the present invention.

FIG. 7 is a front view showing another example of the structure for drawing/putting a rack assembly out of/into the refrigerator in accordance with the present invention.

As shown, a roller type second guide portion 262 is constructed to be rotated centered about a shaft 262*a* in a state of being inserted in a guide groove 161 so that the rack assembly 150 can be smoothly drawn/put out of/into the cooling chamber.

Because the rack assembly 150 can be more smoothly drawn out of the cooling chamber 130 by such a roller type second guide portion 262, the refrigerator is very convenient to use.

Figure 8:
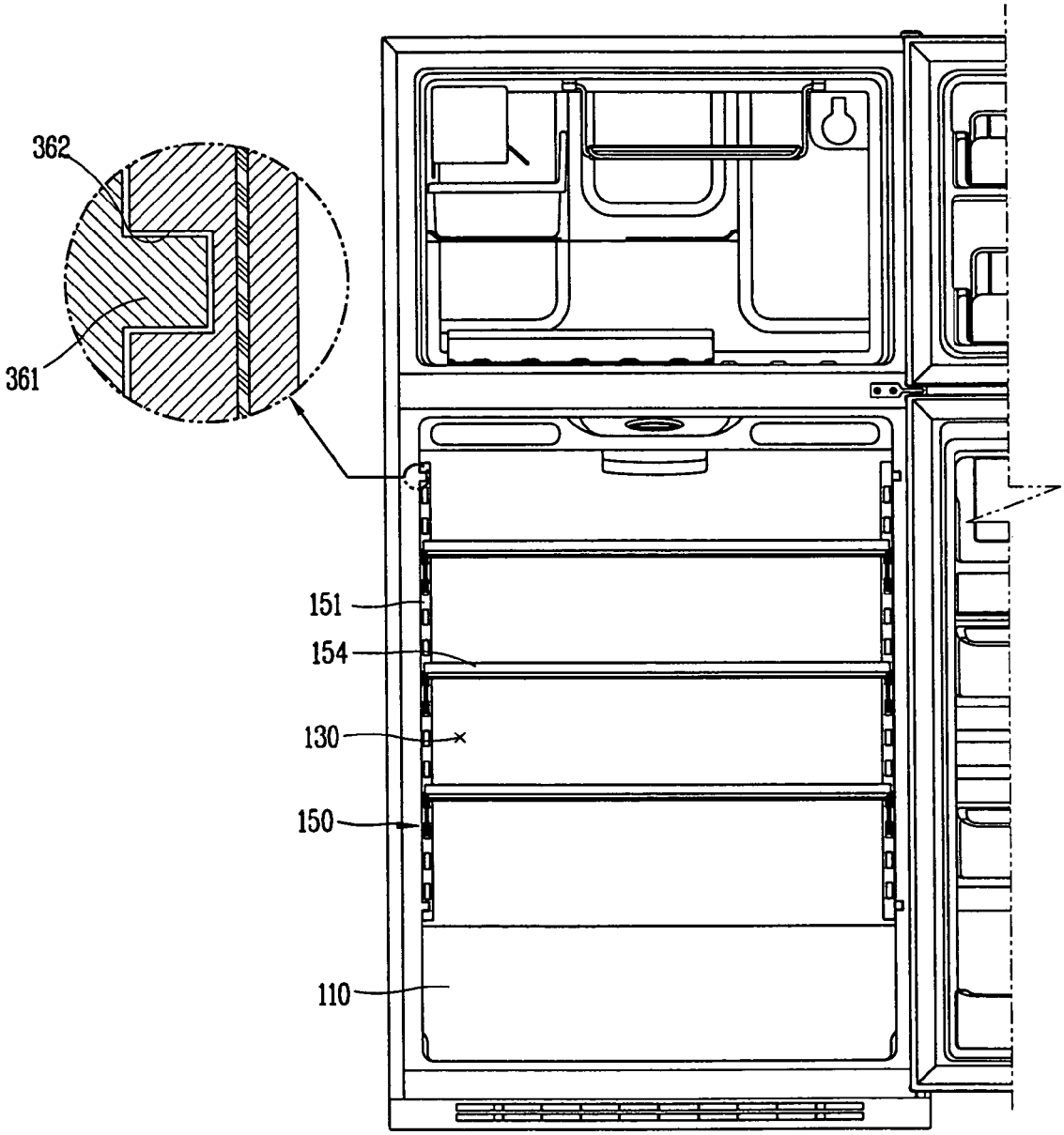
FIG. 8 is a front view showing still another example of a structure for drawing/putting a rack assembly out of/into a refrigerator in accordance with the present invention.

FIG. 8 is a front view showing still another example of a structure for drawing/putting the rack assembly out of/into the refrigerator in accordance with the present invention.

As shown, guide protrusions 361 are formed at both inner sides of the cooling chamber 130, and guide grooves 362 are formed at sides of the frame 151, corresponding to the guide protrusions 361.

In case of forming the guide groove 362 at the frame 362 and forming the guide protrusions 361 at both inner sides of the cooling chamber 130 as described above, the size of the cooling chamber may be larger than that of the cooling chamber of the refrigerator shown in FIG. 5.

Hereinafter, the operation of the refrigerator in accordance with one embodiment of the present invention will now be described with FIGS. 3 to 6.

When a plurality of food containers 16*a*, 16*b* are stored on a rack 154 of the rack assembly 150 and a user draws the rack assembly 150 frontward to take out or check the desired food container, the rack assembly 150 is frontward slid by the second guide portion 162 slidably inserted in the first guide portion 161.

When the rack assembly 150 is slid and drawn out of the cooling chamber 130 at a certain extent, the movement of the rack assembly 150 is stopped, and the user can easily take out or check the food container stored on the rack 154.

Here, because the side cover 152 is made of an acryl material which is transparent, the user can more easily identify the desired food container.

In contrast, when the user pushes the rack assembly 150 rearward into the cooling chamber 130 to make the rack assembly 150 received in the cooling chamber 130, the rack assembly 150 is slid by the second guide portion 162 slidably inserted in the first guide portion 161 to thereby be received in the cooling chamber 130.

Meanwhile, because the second guide member 162 is made of a vibration preventing rubber material, vibration generated from a compressor or the like in operation of the refrigerator is not transmitted to the rack 154, so that food containers put on the rack 154 can be safely stored therein and the vibration noise can be effectively prevented.

As so far described, as for the refrigerator in accordance with the present invention, food containers put on a rack of a rack assembly can be easily and conveniently taken out or checked regardless their locations by constructing the rack assembly to be selectively drawn out of a cooling chamber.

Also, by attaching a vibration preventing rubber material to an end of the rack assembly, the food container put on the rack is prevented from being dropped, and the vibration noise can be effectively prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator, comprising:

a chamber having two opposite lateral walls, each of the lateral walls being a substantially flat plane extending from a top of the chamber to a bottom of the chamber, each of the lateral walls having one of at least one groove extending from the substantially flat plane inwardly away from the opposite lateral wall and at least one protrusion extending from the substantially flat plane outwardly toward the opposite lateral wall; and a rack assembly installed inside the chamber, the rack assembly having one of at least one rack protrusion corresponding to the at least one groove and at least one rack groove corresponding to the at least one protrusion, the at least one protrusion being located in the at least one rack groove or the at least one rack protrusion being located in the at least one groove such that the rack assembly is movable along a direction of the one of the at least one groove and the at least one protrusion, wherein the rack assembly consists of:

a pair of rails vertically installed at a certain interval, the one of at least one rack groove and at least one rack protrusion being located on each of the rails;

side covers facing a corresponding one of the two opposite lateral surfaces of the chamber, each of the side covers being inserted into one of the rails, wherein each of the side covers has a substantially same thickness throughout each of the entire side covers in a horizontal direction, and the thickness of each of the side covers in the horizontal direction is smaller than a width of a corresponding one of the rails in the horizontal direction;

a rear cover facing a rear surface of the chamber, the rear cover being inserted into the rails; and at least one rack horizontally installed in a space formed by the side covers and the rear cover.

2. The refrigerator of claim 1, wherein the side cover is made of a transparent material.

3. The refrigerator of claim 2, wherein the side cover is made of an acryl material.

4. The refrigerator of claim 1, wherein a plurality of rack support members for supporting the rack are fixedly installed at an inner surface of each side cover.

5. The refrigerator of claim 4, wherein the rack support members are made of a vibration preventing material.

6. The refrigerator of claim 4, wherein the rack support members support both ends of the rack.

7. The refrigerator of claim 1, wherein the protrusion is made of a rubber material.

8. The refrigerator of claim 1, wherein the protrusion is a roller rollable in the groove.

9. The refrigerator of claim 1, wherein the side covers and the rear cover substantially extend from a top end of the rails to a bottom end of the rails.

10. The refrigerator of claim 1, wherein the at least one rack includes a plurality of racks.

11. The refrigerator of claim 1, wherein each of the lateral walls has the at least one groove, the at least one groove extending through a front edge of the corresponding lateral wall to have an open end.

12. The refrigerator of claim 1, wherein a front end of a lateral surface of the at least one rack extends outwardly further toward a front side of a chamber of the refrigerator than a front end of the side covers such that the front end of the lateral surface of the at least one rack is not flush with the front end of the side covers.

13. A refrigerator comprising:

a main body including a chamber therein, the chamber having two opposite lateral walls, each of the lateral walls having one of at least one groove and at least one protrusion; and a rack assembly installed inside the chamber, the rack assembly consisting of:

a plurality of racks;

a pair of rear vertical rails spaced apart from each other, each of the rear vertical rails having the other one of the at least one groove and the at least one protrusion, the rear vertical rails supporting the entire rack assembly, the at least one protrusion being located in the at least one groove such that the rack assembly is movable along a direction of the at least one groove;

sides covers located at both sides of the racks, the side covers substantially extending from a top end of the rear vertical rails to a bottom end of the rear vertical rails, wherein each of the side covers has a substantially same thickness throughout each of the entire side covers in a horizontal direction, and the thickness of each of the side covers in the horizontal direction is smaller than a width of a corresponding one of the rear rails in the horizontal direction; and a rear cover located at a rear surface of the racks, the rear cover substantially extending from the top end of the rear vertical rails to the bottom end of the rear vertical rails.

14. The refrigerator of claim 13, wherein the other one of the at least one groove and the at least one protrusion is located at a sidewall of each of the rear vertical rails, the sidewall facing the corresponding one of the lateral walls of the chamber.

15. The refrigerator of claim 14, wherein the protrusion is made of a rubber material.

16. The refrigerator of claim 14, wherein the protrusion is a roller rollable in the groove.

17. The refrigerator of claim 13, wherein the side cover is made of a transparent material.

18. The refrigerator of claim 16, wherein the side cover is made of an acryl material.

19. The refrigerator of claim 13, wherein a plurality of rack support members for supporting the rack are fixedly installed at an inner surface of the side cover.

20. The refrigerator of claim 19, wherein the rack support member is made of a rubber material.

21. The refrigerator of claim 13, wherein each of the lateral walls has the at least one groove, the at least one groove extending through a front edge of the corresponding lateral wall to have an open end.

22. The refrigerator of claim 13, wherein a front end of a lateral surface of each of the racks extends outwardly further toward a front side of the chamber than a front end of the side covers such that the front end of the lateral surface of each of the racks is not flush with the front end of the side covers.

* * * * *